US009898885B1

(12) United States Patent
Wang

(10) Patent No.: US 9,898,885 B1
(45) Date of Patent: Feb. 20, 2018

(54) PRIZE-DISPENSING APPARATUS

(71) Applicant: YOUAL JIFH ENTERPRISE CO., LTD., Taichung (TW)

(72) Inventor: Chih-Chieh Wang, Taichung (TW)

(73) Assignee: YOUAL JIFH ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 15/696,374

(22) Filed: Sep. 6, 2017

(51) Int. Cl.
*G07F 11/44* (2006.01)
*G07F 11/16* (2006.01)

(52) U.S. Cl.
CPC ..... *G07F 11/165* (2013.01); *G07F 11/44* (2013.01)

(58) Field of Classification Search
CPC ..... A01M 23/14; A01M 23/24; A01M 23/34; A01M 23/36; A01M 27/00
USPC ..... 700/237; 294/88, 206; 273/447, 448; 1/1; D21/721; 119/795
See application file for complete search history.

(56) References Cited

U.S. PATENT DOCUMENTS 889,586 A * 6/1908 Cook ..... A01K 15/003 119/806
4,172,610 A * 10/1979 Johnson ..... A47G 21/10 294/100
5,415,417 A * 5/1995 Reis, Jr. ..... A63F 9/30 273/447
6,234,487 B1 * 5/2001 Shoemaker, Jr. ..... A63F 9/30 273/447
6,361,094 B1 * 3/2002 Pelley ..... A63B 47/02 294/115
2003/0151202 A1 * 8/2003 Fisher ..... A63F 9/30 273/447
2005/0179273 A1 * 8/2005 Yang ..... A63F 9/30 294/206
2006/0255544 A1 * 11/2006 Halliburton ..... A63F 9/00 273/447

* cited by examiner

*Primary Examiner* — Timothy R Waggoner
*Assistant Examiner* — Ayodeji T Ojofeitimi
(74) *Attorney, Agent, or Firm* — Alan D. Kamrath; Kamrath IP Lawfirm, P.A.

(57) ABSTRACT

A prize-dispensing apparatus includes a casing unit, a preloading unit, a pulling unit, a feed-measuring unit and a grabbing unit. The preloading unit is partially inserted in and movably connected to the casing unit. The pulling unit is inserted in and connected to the casing unit. The grabbing unit includes claws and links. Each claw incudes an upper end pivotally connected to the preloading unit and a lower end for contact with a prize. Each link includes an upper end pivotally connected to the casing unit and a lower end pivotally connected to a portion of a corresponding claw. The claws are closed to grab the prize when the pulling unit is actuated. The claws are opened by the preloading unit when the pulling unit is not actuated. The feed-measuring unit is inserted in the casing unit and used to measure feed of the pulling unit.

3 Claims, 10 Drawing Sheets

PRIZE-DISPENSING APPARATUS

BACKGROUND OF INVENTION

1. Field of Invention

The present invention relates to a game machine and, more particularly, to a prize-dispensing apparatus for a game machine.

2. Related Prior Art

A crane machine (or "claw machine") includes a claw and a crane inserted in a booth. Prizes such as dolls and 3C products are inserted in the booth. In operation, the claw is moved to a position above a desired one of the prizes by the crane, lowered and then closed to grab the desired prize. Then, the claw is raised, moved to a position above a chute by the crane, and opened to drop the desired prize onto the chute so that the prize slips out of the booth along the chute and is claimed.

A solenoid and an iron core are used to control the closing and open end of the claw. The design of the iron core could cause inadequate closing or/and open end of the claw. The solenoid could be too hot to provide the claw with a proper force for grabbing the desired prize. In either case, the desired prize could fall from the claw before the claw arrives in the position above the chute. To solve this problem, the solenoid is provided with a stronger current, or the solenoid is made with a larger number of turns. However, both solutions consume more electricity and produce more heat that could overheat the solenoid.

The present invention is therefore intended to obviate or at least alleviate the problems encountered in prior art.

SUMMARY OF INVENTION

It is the primary objective of the present invention to provide a game machine with a prize-dispensing apparatus that is light in weight, consumes a relatively small amount of electricity and produces a relatively small amount of heat.

To achieve the foregoing objective, the prize-dispensing apparatus includes a casing unit, a preloading unit, a pulling unit, a feed-measuring unit and a grabbing unit. The preloading unit is partially inserted in and movably connected to the casing unit. The pulling unit is inserted in and connected to the casing unit. The grabbing unit includes claws and links. Each claw incudes an upper end pivotally connected to the preloading unit and a lower end for contact with a prize. Each link includes an upper end pivotally connected to the casing unit and a lower end pivotally connected to a portion of a corresponding claw. The claws are closed to grab the prize when the pulling unit is actuated. The claws are opened by the preloading unit when the pulling unit is not actuated. The feed-measuring unit is inserted in the casing unit and used to measure feed of the pulling unit.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
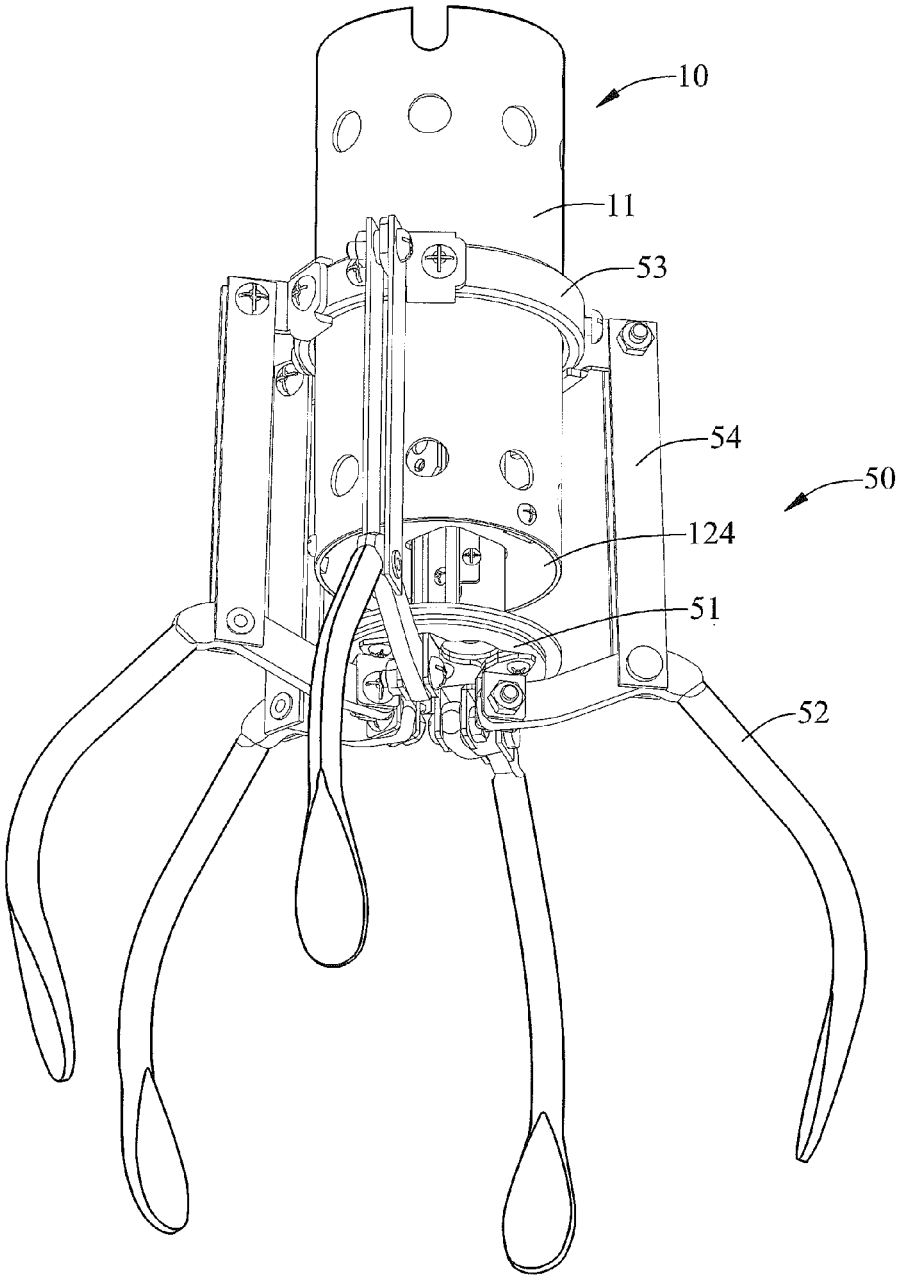
FIG. 1 is a perspective view of a prize-dispensing apparatus according to the preferred embodiment of the present invention.
Figure 2:
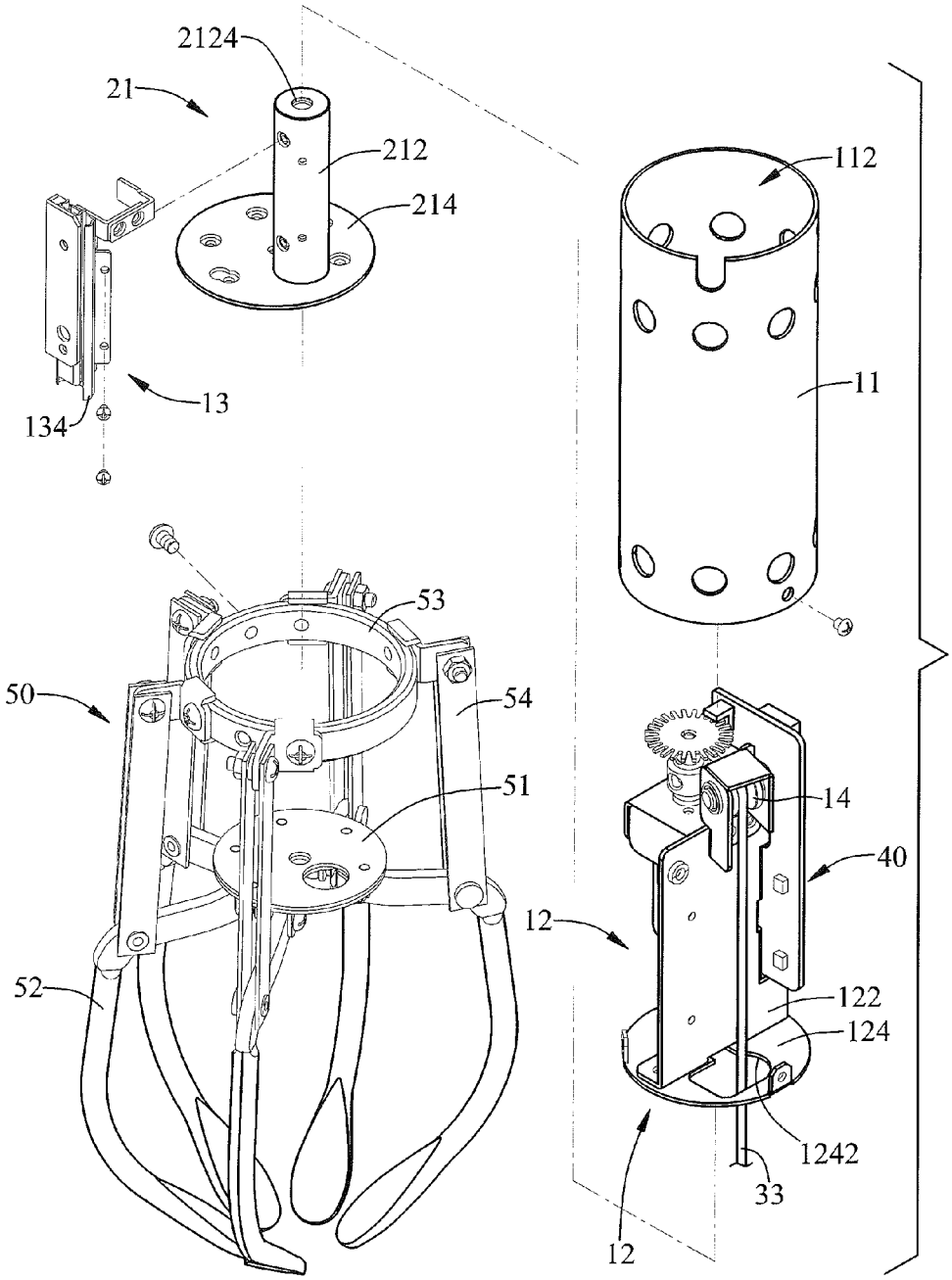
FIG. 2 is an exploded view of the prize-dispensing apparatus in another position than shown in FIG. 1.
Figure 3:
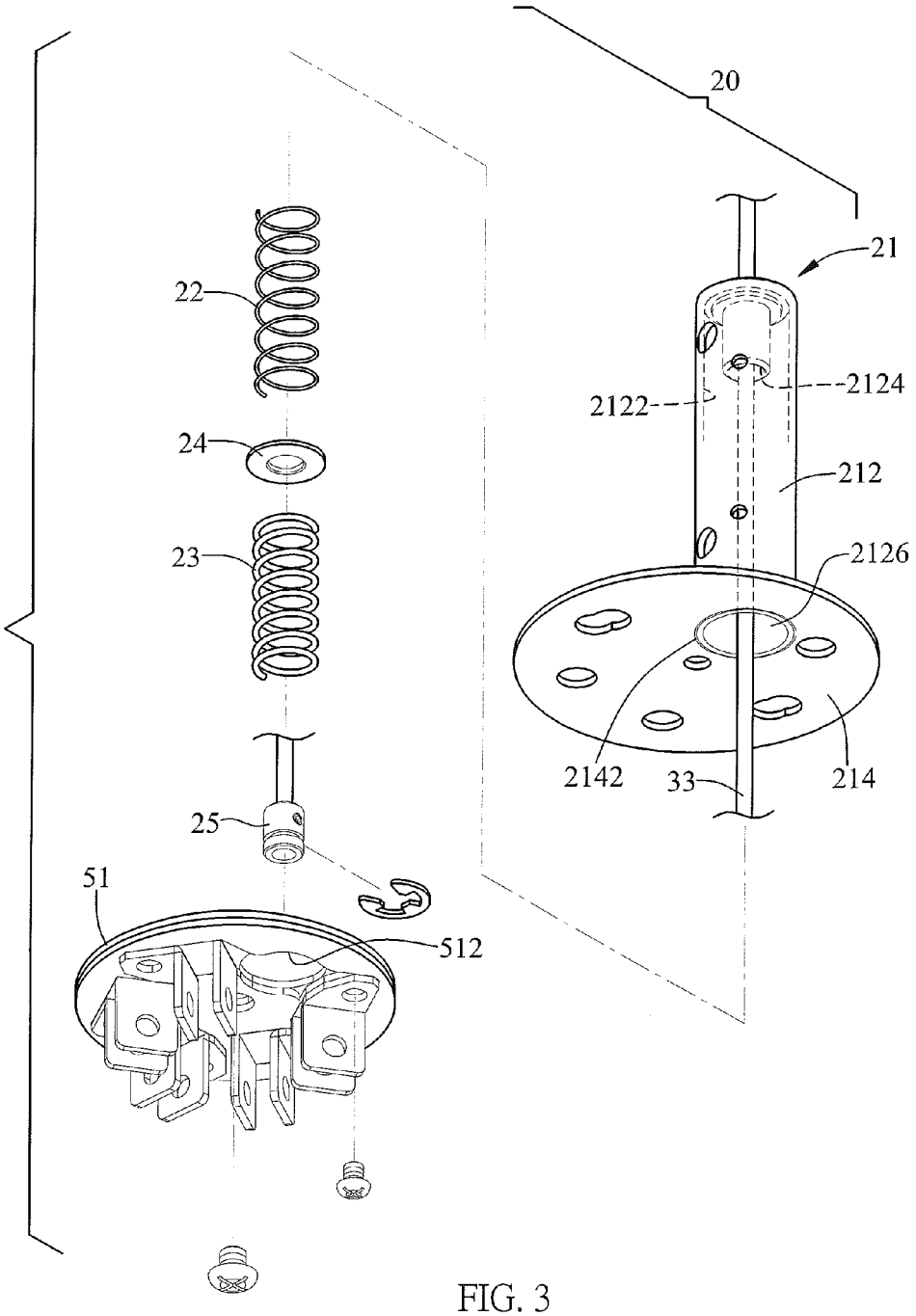
FIG. 3 is a partial view of the prize-dispensing apparatus depicted in FIG. 2.

Referring to FIGS. 1 to 6, a prize-dispensing apparatus includes a casing unit 10, a preloading unit 20, a pulling unit 30, a feed-measuring unit 40 and a grabbing unit 50 according to the preferred embodiment of the present invention. Casing unit 10 includes a shell 11, a frame 12, a track set 13 and an idle pulley 14. Shell 11 is made with a space 112 that includes an open lower end (not numbered). Frame 12 includes a wall 122 and a base 124. Base 124 is inserted in space 112 and connected to shell 11 so that base 124 is located in the open lower end of space 112. Base 124 includes an aperture 1242 via which space 112 is in communication with the exterior of shell 11. Wall 122 is located on and perpendicularly connected to base 124. Track set 13 includes two tracks 132 and 134. Track 132 includes a dovetail movably inserted in a dovetail groove made in track 134. Track 132 is connected to wall 122 of frame 12. Idle pulley 14 is connected to wall 122 of frame 12.

Referring to FIGS. 2 to 6, preloading unit 20 includes a movable element 21, two springs 22 and 23, an upper spacer 24 and a lower spacer 25. Movable element 21 includes a cylinder 212 extending from a disc 214 perpendicularly. Cylinder 212 is inserted in aperture 1242 so that disc 214 is located beneath and connected to base 124. Cylinder 212 includes a tunnel 212 with an upper hole 2124 made in an upper end and a lower hole 2126 made in a lower end. Upper hole 2124 is smaller than lower hole 2126. Cylinder 212 is connected to track 134 of track set 13. Springs 22 and 23 are inserted in tunnel 2122, one located above the other. Spring 22 includes an upper end placed against the upper end of tunnel 2122. Upper and lower spacers 24 and 25 are inserted in tunnel 2122. Upper spacer 24 is located between springs 22 and 23. Lower spacer 25 is located against a lower end of spring 23. Lower spacer 25 includes a C-clip (not numbered) inserted in an annular groove (not numbered)

made in a block (not numbered). The C-clip is placed against the lower end of spring 23 while the block is inserted in spring 23.

Figure 4:
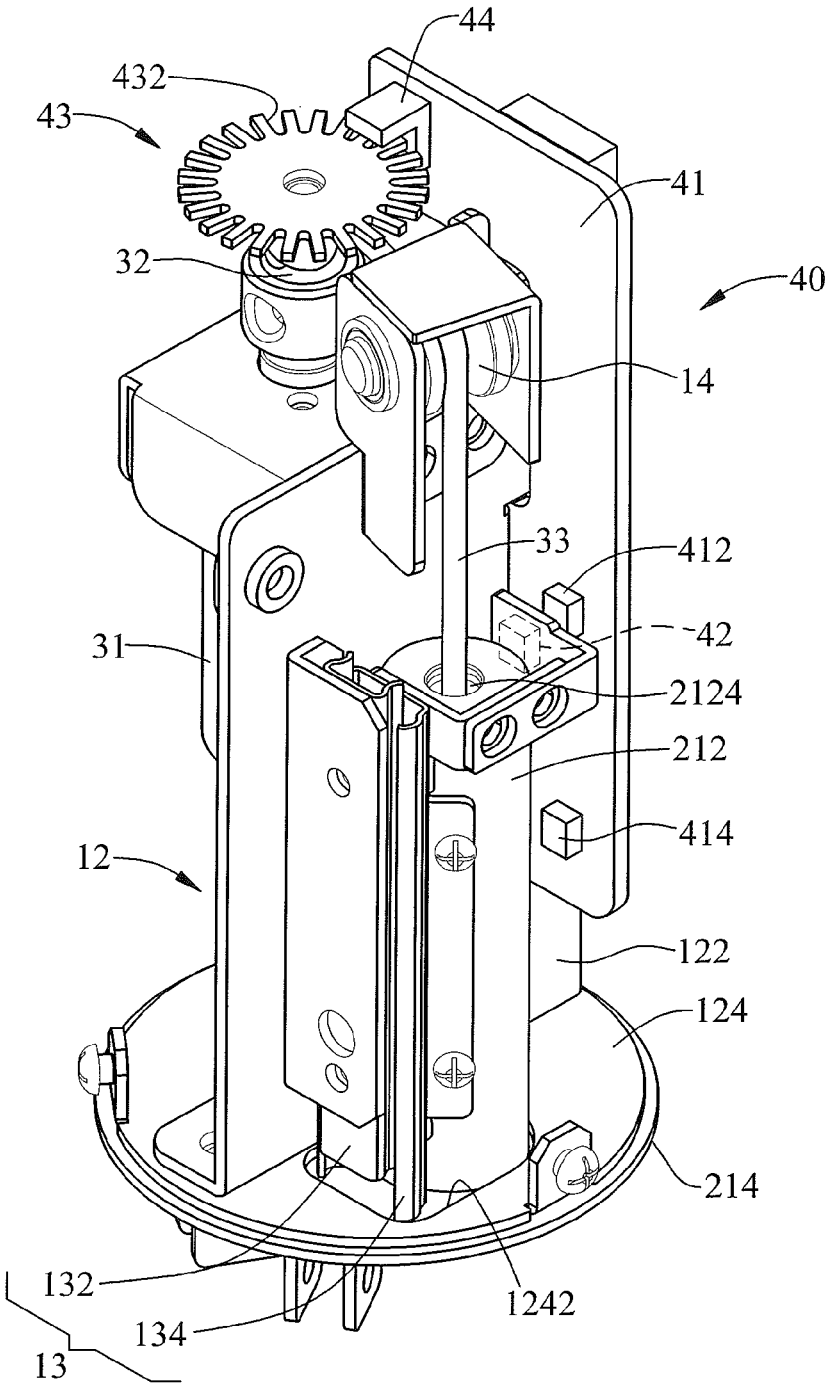
FIG. 4 is another partial view of the prize-dispensing apparatus shown in FIG. 2.
Figure 5:
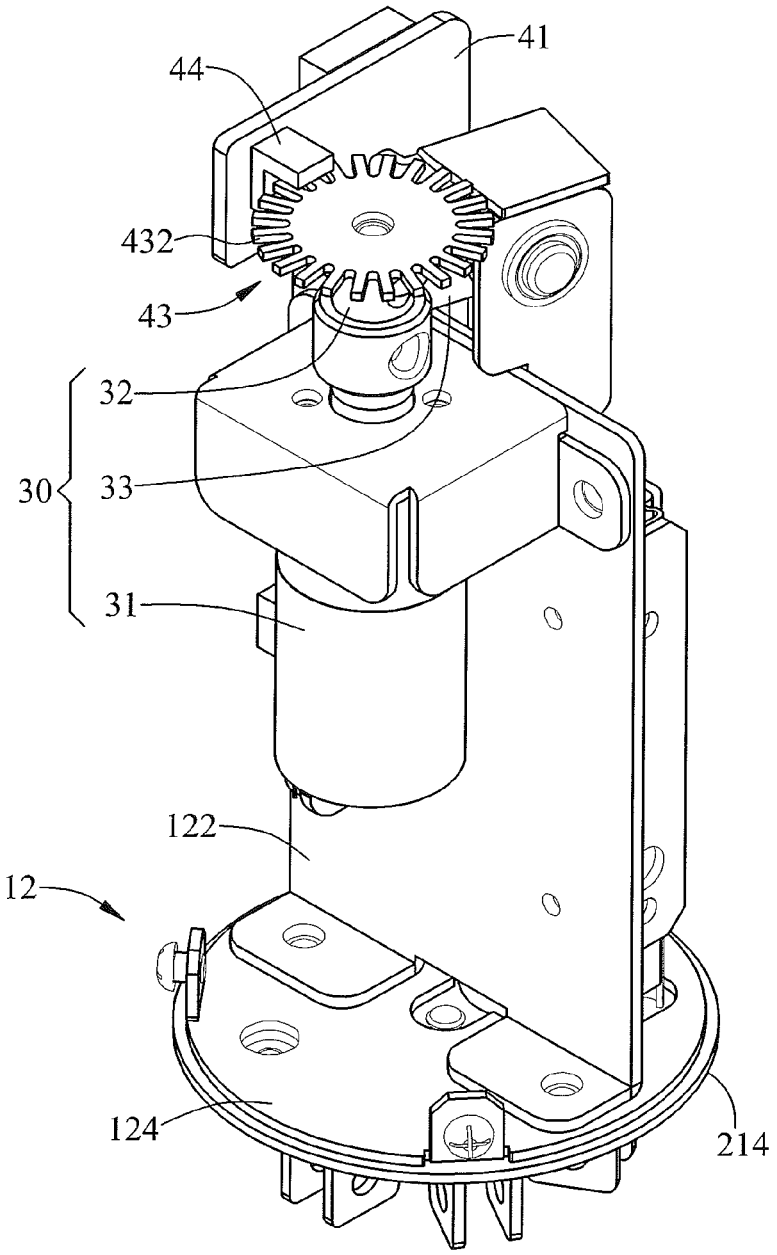
FIG. 5 is another perspective view of the prize-dispensing apparatus shown in FIG. 4.
Figure 7:
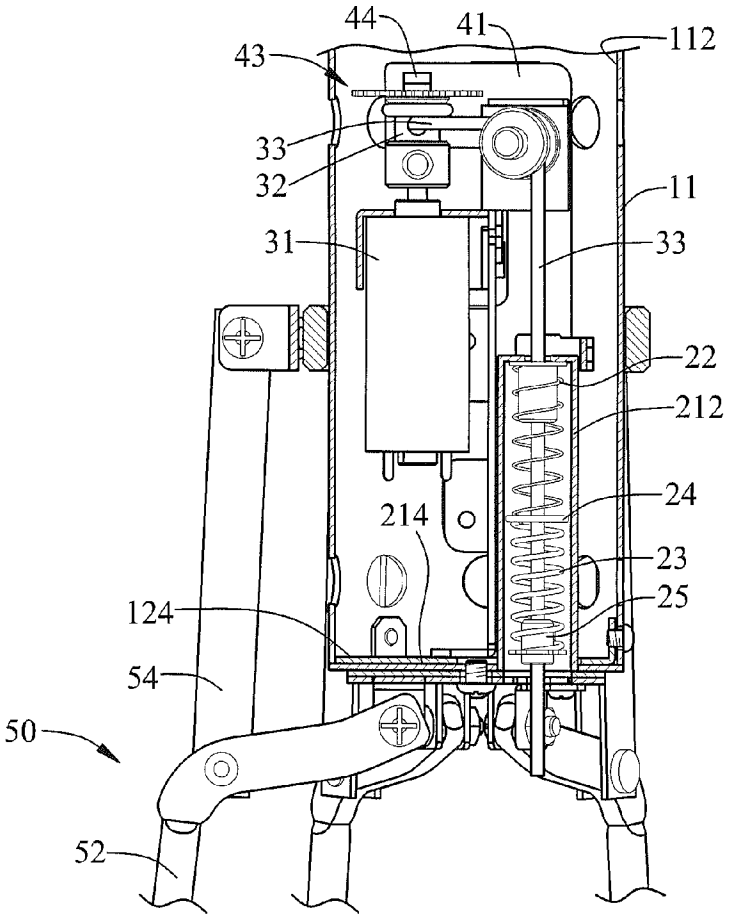
FIG. 7 is a partial, cross-sectional view of the prize-dispensing apparatus in another position than shown in FIG. 6.
Figure 6:
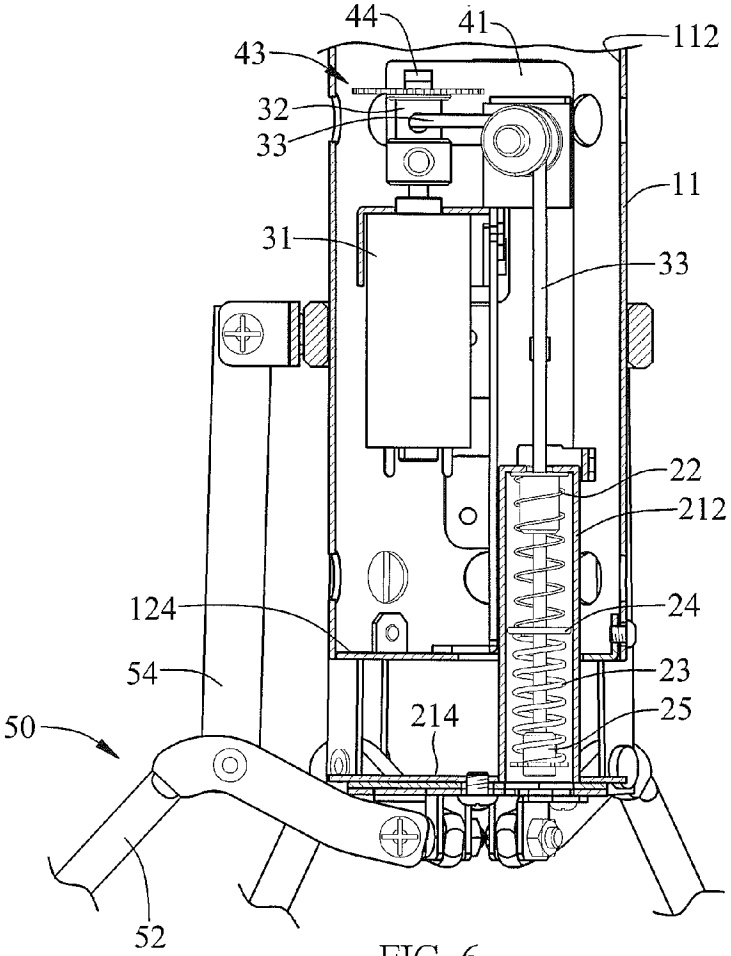
FIG. 6 is a partial, cross-sectional view of the prize-dispensing apparatus depicted in FIG. 1.
Figure 8:
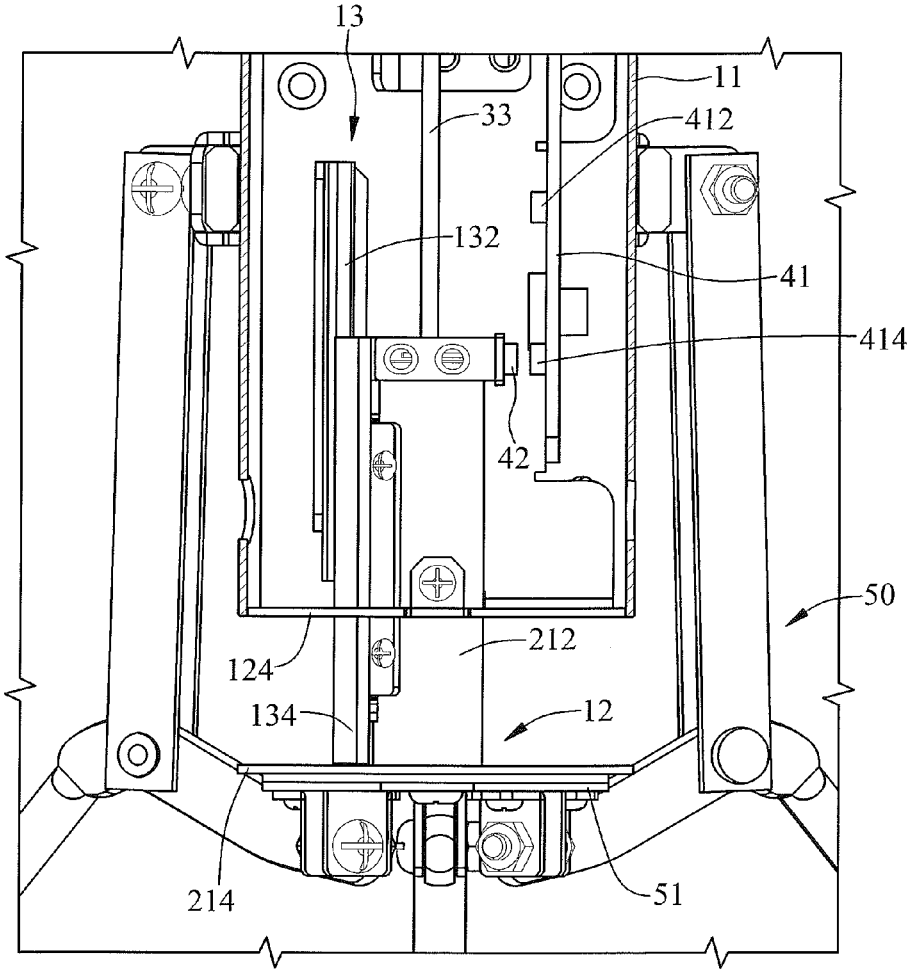
FIG. 8 is a partial, cross-sectional view of the prize-dispensing apparatus in another position than shown in FIG. 7.
Figure 9:
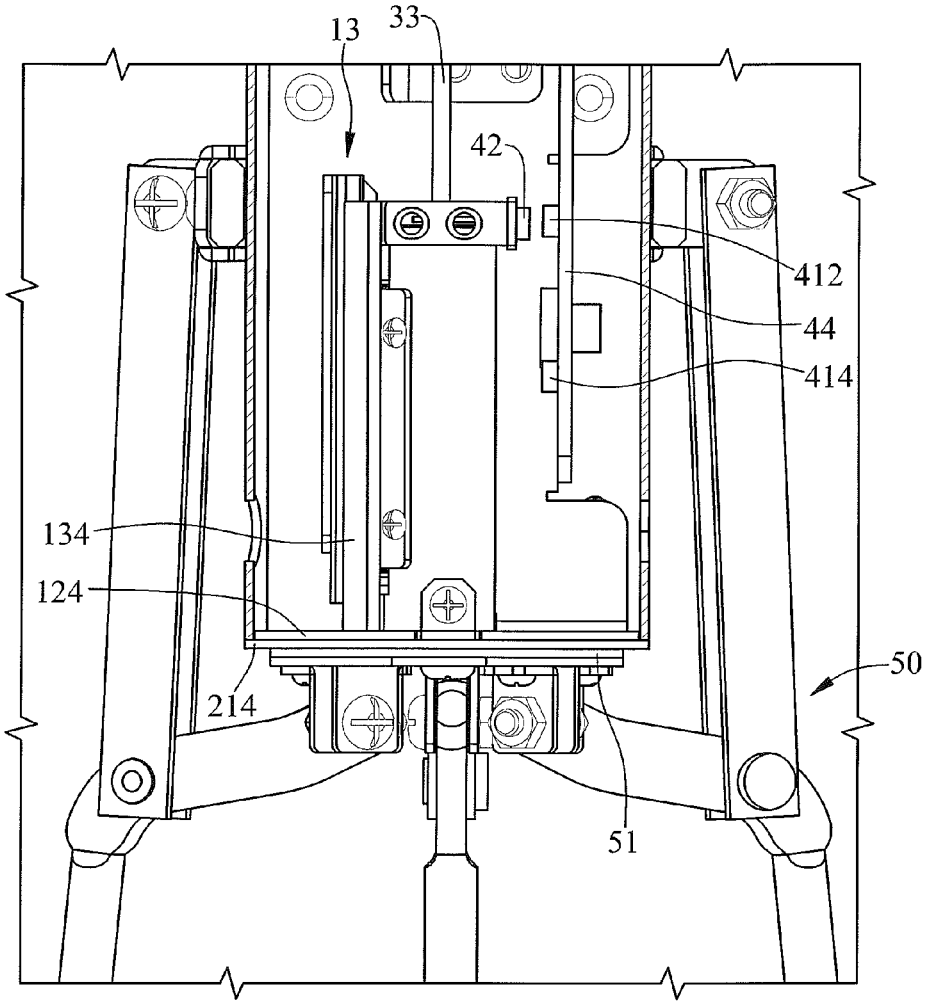
FIG. 9 is a partial, cross-sectional view of the prize-dispensing apparatus in another position than shown in FIG. 8.
Figure 10:
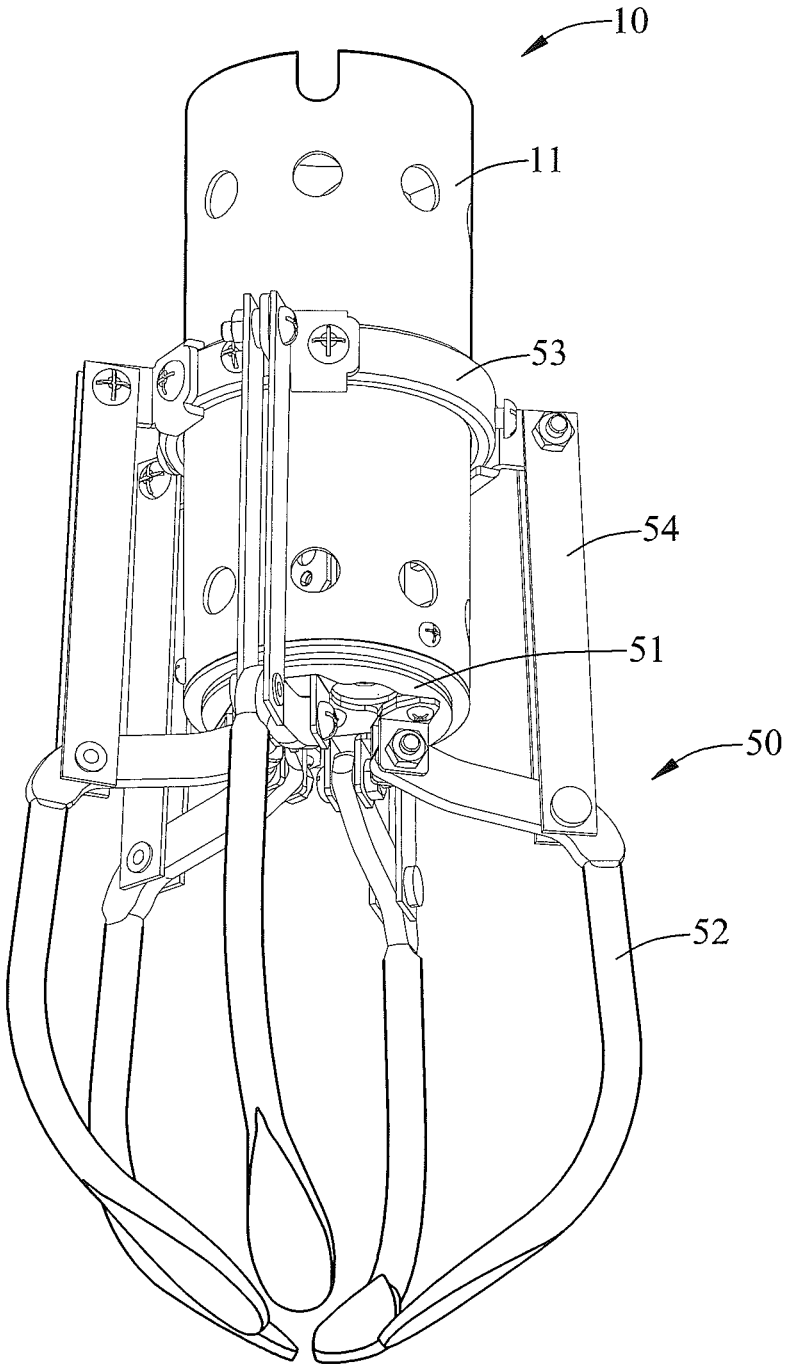
FIG. 10 is a perspective view of the prize-dispensing apparatus in another position than shown in FIG. 1.

Referring to FIGS. 4 to 6, pulling unit 30 includes a motor 31, a winch 32 and a rope 33. Motor 31 is connected to wall 122 of frame 12. Winch 32 is connected to and rotated by a mandrel (not shown) of motor 31. Rope 33 is wound around winch 32 and idle pulley 14. Moreover, rope 33 extends throughout upper hole 2124 of cylinder 212, spring 22, upper spacer 24 and spring 23. Rope 33 includes an end connected to winch 32 and another end connected to lower spacer 25. Thus, rope 33 is operable to pull movable element 21 to adjust force preloaded in springs 22 and 23. Springs 22 are 23 made with different values of stiffness. Preferably, the value of stiffness of spring 23 is larger than that of spring 22.

Referring to FIGS. 4 to 6, feed-measuring unit 40 includes a circuit board 41, a magnet 42, a coding disc 43 and an encoder 44. Circuit board 41 is connected to wall 122 of frame 12. Circuit board 41 includes an upper sensor 412 and a lower sensor 414. Upper sensor 412 is located near an upper end of circuit board 41, and lower sensor 414 a lower end of circuit board 41. Magnet 42 is connected to track 134 so that they are moveable together. Magnet 42 is made corresponding to upper and lower sensors 412 and 414. Magnet 42 is detected by upper sensor 412 when the former gets near the latter. Magnet 42 is detected by lower sensor 414 when the former gets near the latter. Coding disc 43 is connected to the mandrel of motor 31 so that they are rotatable together. Coding disc 43 is a grating element made with cutouts 432 along its edge. Encoder 44 is electrically connected to circuit board 41, corresponding to coding disc 43. Encoder 44 is an optical sensor operable to measure the rotation of motor 31 via cutouts 432 of coding disc 43. Thus, the feed of motor 31 is measured.

Referring to FIGS. 1 to 6, grabbing unit 50 is connected to a lower face of disc 214 of movable element 21 and connected to shell 11. Grabbing unit 50 includes a plate 51, claws 52, a collar 53 and links 54. Plate 51 is connected to the lower face of disc 214 of movable element 21. Plate 51 is made with a bore 512 corresponding to opening 2142 and lower hole 2126. Each claw 52 includes an upper end pivotally connected to plate 51. Collar 53 is provided around shell 11. Each link 54 includes an end pivotally connected to collar 53 and another end pivotally connected to a proper portion of a corresponding claw 52.

Referring to FIGS. 4 to 6 and 8, motor 31 of pulling unit 30 normally does not drive rope 33. Thus, cylinder 212 of preloading unit 20 is allowed to extend out of casing unit 10 via aperture 1242 under guidance of track set 13 due to the weight of preloading unit 20. Plate 51, which is connected to disc 214 of preloading unit 20, is synchronously lowered, and so are upper ends of claws 52. Hence, lower ends of claws 52 are raised and spread. That is, claws 52 are opened.

Magnet 42, which is connected to track 134, is detected by lower sensor 414 of circuit board 41 as preloading unit 20 reaches a lower limit. Lower sensor 414 accordingly provides a signal.

Referring to FIGS. 4 to 12, motor 31 is turned on to rotate winch 32 and coding disc 43. Winch 32 reels rope 33 to raise preloading unit 20 along track set 13 so that preloading unit 20 reaches base 124 of frame 12 of casing unit 10. Synchronously, magnet 42, which is connected to track 134, is raised. Magnet 42 is detected by upper sensor 412 of circuit board 41. Upper sensor 412 accordingly provides a signal.

In the foregoing process, coding disc 43 actuates encoder 44 to digitize the rotation of motor 31. Thus, the feed of motor 31 is measured, and rope 33 is accordingly wound onto or released from winch 32.

Figure 12:
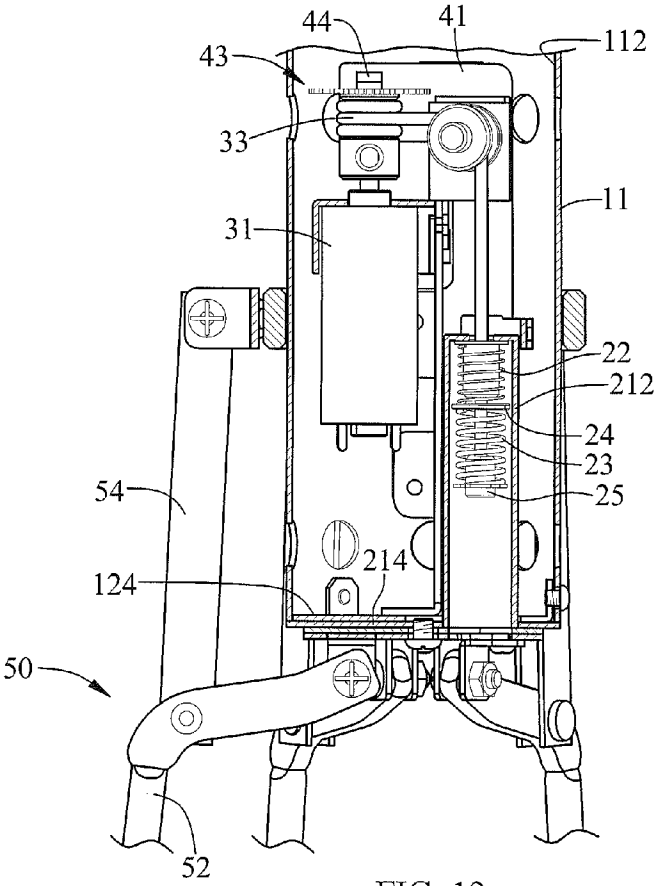
FIG. 12 is a partial, cross-sectional view of the prize-dispensing apparatus in another position than shown in FIG. 11.
Figure 11:
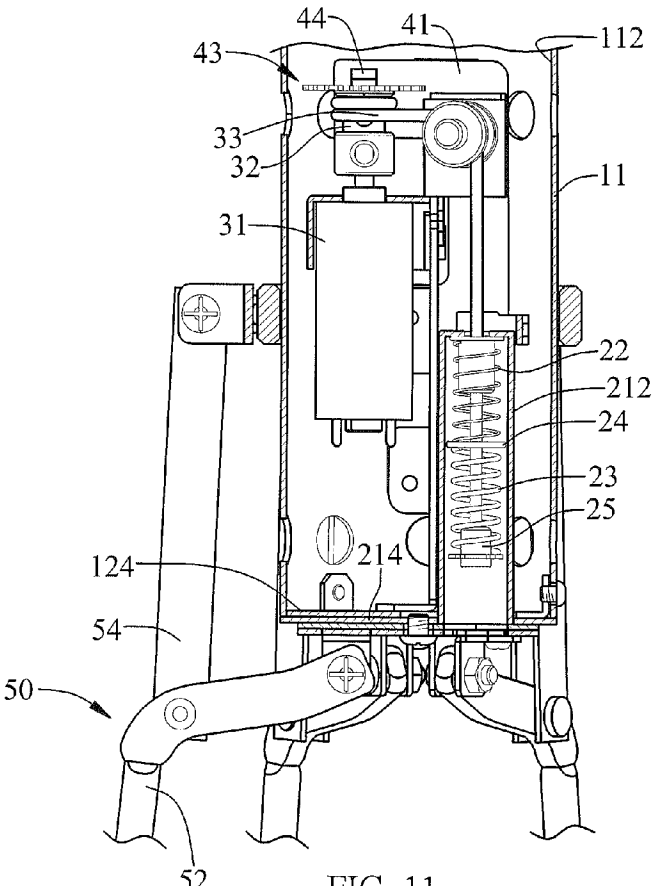
FIG. 11 is a partial, cross-sectional view of the prize-dispensing apparatus in another position than shown in FIG. 9.

As mentioned above, preloading unit 20 raises plate 51 to close claws 52. Referring to FIGS. 11 and 12, claws 52 are kept closed because they are biased by springs 22 and 23. Forces exerted on claws 52 by springs 22 and 23 are adjustable by the feed of motor 31 of pulling unit 30.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims

The invention claimed is:

1. A prize-dispensing apparatus comprising:

a casing unit (10) comprising:

a shell (11) comprising a space (112) with an open lower end;

a frame (12) comprising:

a base (124) inserted in the space (112) and made with an aperture (1242) in communication with the open lower end of the space (112); and a wall (122) supported on the base (124);

a track set (13) connected to the wall (122); and an idle pulley (14) connected to the wall (122);

a preloading unit (20) comprising:

a movable element (21) comprising:

a cylinder (212) comprising a tunnel (2122) and upper and lower holes (2124, 2126) in communication with the tunnel (2122), wherein the cylinder (212) extends throughout the aperture (1242) of the base (124) and is connected to and guided by the track set (13); and a disc (214) connected to a lower end of the cylinder (212) and comprising an opening (2142) corresponding to the lower hole (2126);

first and second springs (22, 23) made with different values of stiffness and inserted in the tunnel (2122), wherein the first spring (22) comprises an upper end placed against an upper end of the tunnel (2122);

an upper spacer (24) inserted in the tunnel (2122) and located between the first and second springs (22, 23); and a lower spacer (25) inserted in the tunnel (2122) and located against a lower end of the second spring (23);

a pulling unit (30) comprising:

a motor (31) connected to the wall (122);

a winch (32) connected to and rotated by the motor (31); and a rope (33) connected to the winch (32) at an end and connected to the lower spacer (25) at another end, wherein the rope (33) is wound on the winch (32) and the idle pulley (14) and extends throughout the upper hole (2124) of the cylinder (212) of the movable element (21), the first spring (22), the upper spacer (24) and the second spring (23);

a feed-measuring unit (40) comprising:

a circuit board (41) attached to the wall (122), electrically connected to the motor (31), and made with an upper sensor (412) and a lower sensor (414);

a magnet (42) connected to the track set (13) and detectable by the upper and lower sensors (412, 414); and a coding disc (43) connected to and rotated by the motor (31); and an encoder (44) electrically connected to the circuit board (41) and adapted for cooperation with the coding disc (43) to digitize the rotation of the motor (31) to measure feed of the motor (31); and a grabbing unit (50) comprising:

a plate (51) connected to a lower face of the disc (214) and made with a bore (512) corresponding to the opening (2142);

claws (52) each of which comprises an upper end pivotally connected to the plate (51);

a collar (53) located around and connected to the shell (11); and links (54) each of which comprises an end pivotally connected to the collar (53) and another end pivotally connected to a portion of a corresponding one of the claws (52).

2. The prize-dispensing apparatus according to claim 1, wherein the track set (13) comprises:

a first track (132) connected to the wall (122); and a second track (134) connected to the cylinder (212), wherein the first and second tracks (132, 134) are movably connected to each other, wherein the magnet (42) is attached to the second track (134).

3. The prize-dispensing apparatus according to claim 1, wherein the coding disc (43) comprises a grating element made with cutouts (432) along an edge.

* * * * *